United States Patent [19]

Lewis

[11] Patent Number: 4,698,296

[45] Date of Patent: Oct. 6, 1987

[54] PROCESSLESS COLOR IMAGING AND FILM THEREFOR

[75] Inventor: David F. Lewis, Monroe, Conn.

[73] Assignee: GAF Corporation, Wayne, N.J.

[21] Appl. No.: 839,390

[22] Filed: Mar. 14, 1986

[51] Int. Cl.[4] ..... G03C 7/20; G03C 7/40; G03C 7/00

[52] U.S. Cl. ..... 430/333; 430/338; 430/344

[58] Field of Search ..... 430/296, 333, 334, 344, 430/338

[56] References Cited

U.S. PATENT DOCUMENTS

| | | | |
|---|---|---|---|
| 2,754,210 | 7/1956 | Elliott | 430/344 |
| 3,501,297 | 3/1970 | Cremeans | 430/338 |
| 3,501,308 | 3/1970 | Adelman | 430/344 |
| 3,560,211 | 2/1971 | Fotland | 430/332 |
| 3,598,583 | 8/1971 | Sprague | 430/344 |
| 4,171,980 | 10/1979 | Ceintrey | 430/344 |
| 4,368,254 | 1/1983 | Vannikov et al. | 430/333 |
| 4,394,439 | 7/1983 | Robillard | 430/344 |

*Primary Examiner*—Won H. Louie

*Attorney, Agent, or Firm*—Marilyn J. Maue; Joshua J. Ward

[57] ABSTRACT

The invention relates to a multilayered image receptive film capable of being developed in distinguishable colors by kinetic energy imparted by radiant beam exposure which comprises (a) a first imaging layer composed of an aliphatic, polymeric binder containing from about 40 wt. % to about 70 wt. % of labile halogen, said binder capable of dehydrohalogenation at address points of radiant energy exposure and having dispersed therein a leuco base polyphenylmethane compound capable of forming a halide salt dye as a first color upon generation of hydrogen halide from said binder; (b) a separate imaging layer composed of a base film containing a photosensitive polyacetylenic compound having at least two acetylenic linkages in a conjugated system and contiguously disposed below said first imaging layer capable of forming a dye of a color distinguishable from that of said halide salt dye and (c) a conductive support for layers (a) and (b).

The invention also relates to a process of multi-color imaging by subjecting said film to a plurality of radiant energy exposures at critically distinct beam energies and exposure dosages individually modulated in accordance with the sensitivity of the dye developing compound in each imaging layer to form dyes of distinguishable colors in each of said imaging layers at the respective points of beam address.

28 Claims, No Drawings

PROCESSLESS COLOR IMAGING AND FILM THEREFOR

In one aspect the invention relates to a multilayered film containing individually distinguishable color developing compounds. In another aspect the invention relates to the process whereby imaging of such film is effected in a plurality of distinguishable colors.

PRIOR ART

Monolayered color imaging with leuco base compounds, fixedly positioned in a binder, is known. Generally, the leuco base together with an acid generating activator is dispersed in a binder, and the dispersion is coated on a conductive support. When exposed to radiant energy, such as photon or particle radiation, acid is liberated from the activator and the ensuing reaction between the acid and the leuco base produces an image in a color corresponding to the dye product. The activator is commonly a low molecular weight compound containing labile halogen from which hydrogen halide is liberated as a result of radiant energy exposure. Such a process is described in U.S. Pat. No. 3,560,211. However, such films are subject to damage or deterioration by exposure to heat and light during normal storage since the activator compounds often cause unwanted predevelopment by formation of acid and concomitant reaction of this product with the leuco dye. Also, such films, when used in a high vacuum environment as in the case of electron beam exposure, tend to lose the activator reactants owing to their volatility at reduced pressures and do not develop full image intensity. Such films are not adaptable to multilayer imaging since the amount of volatilized activator is not easily controlled and the removal of activator by-product from lower layers would be extremely difficult and most probably would cause damage to any superimposed imaging layer.

Additionally, the loss of volatile components of the film in the high vacuum environment of an electron beam exposure device is detrimental to the prolonged error free functioning of that device, since these volatile components become adsorbed upon, and contaminate, surfaces inside the electron optical column.

Alternatively, oil soluble amino azo indicator dyes, which change color at a pH between 2–4 have been substituted for the leuco base compounds since such compounds, as are described in U.S. Pat. Nos. 3,370,981 and 3,425,867, have relatively low volatilities. However, these azo compounds require close control of pH in the imaging layer to effect proper color development and often produce unstable conditions, which problems would be multiplied in a system employing several superimposed imaging layers.

Monocolor imaging with polyacetylene crystals fixedly positioned on a base film is also known as disclosed in U.S. Pat. No. 3,501,302. However, because of the wide discrepancy between leuco base compound and polyacetylene compound sensitivity responsive to exposure dosages required for imaging, these materials have been regarded as incompatible in the same system.

Accordingly, it is an object of the present invention to overcome the above disadvantages and to provide a commercially acceptable multilayered imaging film for development in several distinguishable colors by an efficient and commercially feasible process.

Another object of the invention is to provide an electron recording film which requires no development, fixing or other processing subsequent to exposure in order to provide a multicolored image.

Another object of the invention is to provide a multilayered imaging film which is not subject to deterioration upon exposure to moisture, light or heat.

Another object is to provide a multilayered imaging film which minimizes volatilization of components during high vacuum radiant energy exposure and which provides a color stable image.

Still another object is to effect multicolored imaging with a lower expenditure of radiant energy.

Yet another object is to provide a process for transducing electrical information into a multicolored visual record.

These and other objects of the invention will become apparent from the following description and disclosure.

THE INVENTION

In accordance with the present invention, there is provided a recording medium having a plurality of superimposed color imaging layers, disposed on a conductive support, which are capable of individual color development at discrete points of address when exposed to a source of radiant energy. The film comprises a first or surface imaging layer composed of a normally solid, aliphatic halogenated polymeric binder capable of dehydro-halogenation in response to energy imparted by a source of radiant energy at a point of impact and having homogeneously dispersed therein a polyphenylmethane leuco base capable of forming a corresponding ionized halide salt dye by interaction with the hydrogen halide generated from the halogenated polymer; a separate imaging layer in which is fixed a photosensitive polyacetylenic compound having at least two acetylenic linkages in a conjugated system; said layer containing the polyacetylenic compound being disposed below the first layer, and capable of forming a dye of a color distinguishable from that which would be developed in the first layer and an electrically conductive support for the above described imaging layers.

While the preferred film of the present invention comprises two imaging layers, namely a first or surface imaging layer containing the uniformly dispersed polyphenylmethane leuco base and a second layer containing the uniformly dispersed polyacetylene compound which second layer is contiguously disposed below the first layer; it is to be understood that films having a plurality of color distinguishable leuco base layers and/or a plurality of layers containing color distinguishable polyacetylene compounds, are also contemplated within the scope of this invention. A tri-color image can also be obtained with only two imaging layers. This is accomplished by selecting a thermochromic polyacetylenic compound, which when heated to a temperature of between about 60° C. and about 140° C., depending upon the compound, converts an image in its original color to an entirely different hue. This color conversion is permanent so that re-exposure of the same polyacetylenic layer with a different image at a lower temperature, e.g. less than 50° C., develops the second image in the original hue or color. Accordingly, a bi-color image can be obtained in the polyacetylenic layer and a mono color image in the leuco dye layer. When films containing three or more color developing layers are employed, the leuco base layer or layers are disposed nearer the surface and are applied over the polyacetylene layer or layers so as to prevent over exposure of the more highly sensitive color developing polyacetylene. To simplify the disclosure, the following discussion is directed mainly to the imaging films containing only two layers.

The process for color development of the above described film depends on the observance of critical parameters, primarily the use of several distinct and critical beam energies and exposure dosages modulated to effect separate penetration, exposure and imaging of the first imaging layer and the first and second imaging layers in combination and to cause generation of hydrogen halide from said halogenated polymer in said first layer at the point of beam impact with simultaneous formation of the halide salt dye and to cause direct color development of the polyacetylenic compound in the second layer.

Imaging of the film requires that the energy be selected which is sufficient to penetrate the individual layer to be developed and a concomitant exposure dosage be employed which is sufficient to cause color development in the specified layer. The order of layer imaging is not critical so that either the first layer or first and second layers can be subjected to the initial radiant energy exposure. In either case, because of the wide dissimilarity between leuco base and polyacetylene sensitivity, imaging is effected in the true and original color of the color developing compound, and color blending, as in the case of multilayered films, containing different leuco bases in a dehydrohalogenatable binder, is entirely eliminated. Hence strongly contrasting colors and attractive formats can be obtained with the present films.

The beam energies are controlled in accordance with the thickness of each individual imaging layer, such that when a surface or first imaging layer of the present film is employed in a thickness of between about 0.1 and about 8 micrometers, preferably between about 0.5 and about 4 micrometers, a corresponding electron beam energy of from about 1 KeV to about 30 Kev, preferably from about 5 KeV to about 20 KeV is required for adequate penetration.

An exposure dosage of between about $1\times10^{-7}$ and about $1\times10^{-1}$ C/cm$^2$, preferably between about $1\times10^{-6}$ and about $1\times10^{-4}$ C/cm$^2$, is employed to cause dehydrohalogenation of the leuco base binder and to develop the corresponding halide salt dye. The second underlying imaging layer, usually having a thickness of between about 0.1 and about 10 micrometers, preferably, between about 0.5 and about 5 micrometers, requires a higher beam energy within the range of between about 5 KeV and about 40 KeV, preferably between about 10 KeV and about 30 KeV, for adequate penetration through the first and into the second imaging layer. However, because of the higher sensitivity of the polyacetylenic compound, a significantly lower exposure dosage than that employed for the first layer is required. Generally an exposure dosage of between about $1\times10^{-10}$ and about $1\times10^{-5}$ C/cm$^2$, preferably between about $1\times10^{-9}$ and about $1\times10^{-6}$ can be used to develop the polyacetylenic dye. The above parameters or equivalent energies and dosages for other sources of radiation must be strictly observed for color stable, multicolor development of the present film.

Because of the higher sensitivity of the polyacetylenic compound, less dwell time to develop an image is required, e.g. from about $10^{-8}$ to about $10^{-5}$ seconds, at an exposed dosage of to $10^{-9}$ to $10^{-7}$ C/cm$^2$. In contrast, a dwell time of from about $10^{-5}$ to about $10^{-3}$ seconds is required for the leuco base surface layer at an exposure dosage of $10^{-6}$ to $10^{-4}$ C/cm$^2$.

As indicated, each electron beam possesses a small and finite penetrating power and the beam energies and layer thicknesses utilized in the present invention must be closely controlled within the above ranges. Such control is obtained by the degree of acceleration of electrons in the electric field between the anode and the cathode of an electron beam apparatus. Failure to apply the proper electron beam energy cannot be corrected by adjusting the degree of film exposure since it is of primary importance that the beam penetrate the layer to be imaged. Thus, regardless of how high the beam intensity, no image will be developed when the beam energy is too low to penetrate the imaging layer selected.

It is particularly preferred that at least the higher beam energy, required for the underlying second layer, be effected by energy transmitted from an electron beam; however, the beam energy used for both layers can be effected with the same or different particulate energy source, if desired. Although it is preferable to effect development of the second imaging layer before imaging the surface layer, the order of exposure may be reversed without departing from the scope of this invention.

The radiant energy contemplated as the energy source in the present invention includes energy generated from an electron beam such as developed by cathode ray guns, ion beams, uncharged particle beams such as molecular beams, gamma rays and X-rays used in radiography, beta rays, electron corona discharge, ultra-violet and actinic radiation, radiation from visible and infra-red regions of the electro magnetic spectrum and other forms of corpuscular and/or wave-like energy generally deemed to be radiant energy.

The preferred source of exposure employed in the present invention is an electron beam. Generally the electrons, under high vacuum, between about $10^{-3}$ and about $10^{-9}$ torr, preferably between about $10^{-5}$ and about $10^{-8}$ torr, at the modulated beam energy required to penetrate and image the selected imaging layer, bombard the selected layer of the film and effect color development into an optical display. In the layer containing the polyacetylenic compound, direct color development is achieved. However in the layer containing the leuco base compound, the electrons bombard the halogenated polymeric binder causing generation of hydrogen halide and simultaneous interaction of the polyphenylmethane dye precursor with the hydrogen halide to form its corresponding halide salt dye for color development at the point of electron impact. The techniques of electron beam recording are well known, thus further amplification is not required. However, for illustrative purposes, a conventional electron beam recording operation suitable for the present invention may utilize an electron beam characterized by having a beam diameter of from about 1 to about 100 micrometers, a current flow of from about $10^{-9}$ to $10^{-5}$ amps and adapted to scan a target area at a rate such that the dwell time is from about $10^{-8}$ to $10^{-3}$ seconds. Vacuum pressures in the film chamber commonly range from about $10^{-3}$ to $10^{-8}$ torr.

Generally, an exposure can be effected by any radiant source including photons, UV light of less than 3,000 Å wavelength, X-rays, gamma rays, beta rays, an ion beam, a molecular beam of uncharged particles, and an electron beam; electron beam being the preferred energy source.

The normally solid, halogenated polymers selected for the first or leuco base imaging layer in the present invention function as binders for the homogeneous distribution of the polyphenylmethane dye precursor and corresponding dyes throughout the layer. These polymers contain between about 10 and about 90 wt. %, preferably between about 40 and about 70 wt. %, of labile halogen and are selected from the group of aliphatic polymers such as for example, polyvinyl halide, polyvinylidene halide and their copolymers containing a minor amount, preferably less than 25%, of comonomers such as, trichloroethylene, dichlorodifluoroethylene, vinyl acetate or lower alkyl acrylate or methacrylate comonomers. The halide moiety of the polymers can be chlorine, bromine or iodine; however, the chlorine containing polymers are preferred and polyvinyl chloride and polyvinylidene chloride homopolymers or vinyl chloride/vinylidene chloride copolymers are most preferred.

The polyphenylmethane compounds of this invention represent a restricted class of leuco base compounds which have the capability of reacting with hydrogen halide to form an ionized halide salt dye, preferably the chloride salt dye. In general, these phenylmethane compounds are represented by the formula

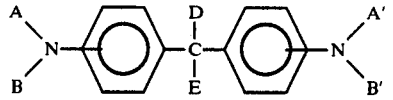

wherein A, B, A' and B' are independently hydrogen or lower alkyl and alternatively A taken with B and N or A' taken with B' and N can form a 4–6 membered heterocyclic ring; D is hydrogen or hydroxy and E is hydrogen, phenyl or naphthyl which aryl radicals may be unsubstituted or substituted with

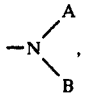

chlorine, bromine, lower alkyl or mixtures of these substituents or D and E, taken together, represent an imino group directly bonded to the carbon atom as =NA.

Examples of such polyphenylmethane dye precursors, preferably diphenylmethane and triphenylmethane precursors, together with their corresponding halide salt dyes are presented in the following Table.

TABLE I

| leuco base precursor | | halide salt dye |
|---|---|---|
| leuco malachite green or leuco malachite green carbinol* | $[(CH_3)_2N-C_6H_4]_2-CH\leftarrow C_6H_5)$ / $[(CH_3)_2N-C_6H_4]_2-C(OH)\leftarrow C_6H_5)$ | 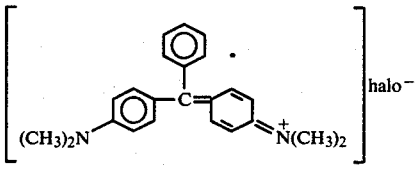 Malachite Green |
| p,p'-bis(aminophenyl)phenyl methane | $[H_2N-C_6H_4]_2-CH\leftarrow C_6H_5)$ | 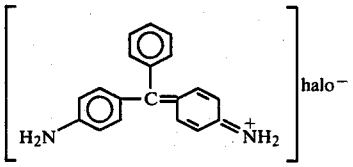 Doebner's Violet |
| 1,4-dichlorophenyl-p,p'-bis(N,N'—dimethylaminophenyl)methane | $[(CH_3)_2N-C_6H_4]_2-CH$ 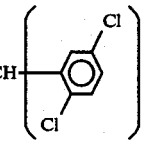 | 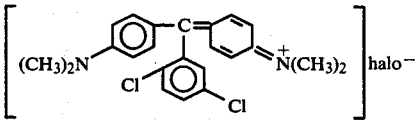 Victoria green |
| p,p',p''-tris(aminophenyl)methane or p,p',p''-tris(aminophenyl)carbinol | $(H_2N-C_6H_4)_3-CH$ / $(H_2N-C_6H_4)_3-C-OH$ | 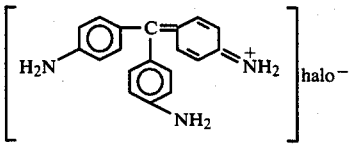 Pararosaniline |

TABLE I-continued

| leuco base precursor | halide salt dye |
|---|---|
| p,p'-bis(aminophenyl) 3-methyl-4-amino-phenyl methane $(NH_2-C_6H_4)_2-CH-(C_6H_3(CH_3)-NH_2)$ | 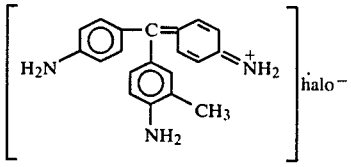 Fuchsine |
| p,p',p''-tris(N,N'—dimethylamino phenyl)methane $[(CH_3)_2N-C_6H_4]_3-CH$ or p,p',p''-tris(N,N'—dimethyl-aminophenyl)carbinol $[(CH_3)_2N-C_6H_4]_3-C-OH$ | 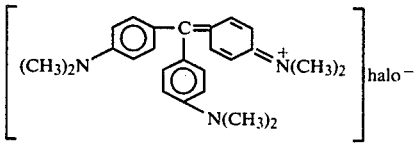 Crystal Violet |
| p,p'-bis(amino-phenyl)-p-(N—methylamino-phenyl)methane $(H_2N-C_6H_4)_2-CH-(C_6H_4)-NH(CH_3)$ | 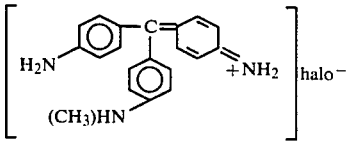 Methyl violet |
| p-aminophenyl-1,4-dichlorophenyl-[2-methyl-3-(N—methylamino) phenyl]methane $[(CH_3HN-C_6H_3(CH_3))]_2-CH-(C_6H_3Cl_2)$ | 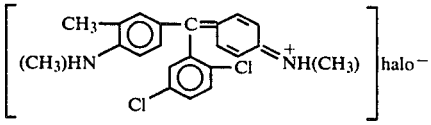 Glacier Blue |
| 2-chlorophenyl-p,p'-bis (N,N—dimethylamino-phenyl)methane $[(CH_3)_2N-C_6H_4]_2CH-(C_6H_4Cl)$ | 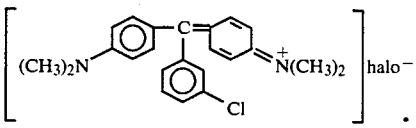 Setoglaucin O |
| $[(CH_3)_2N-C_6H_4]_2C=NH$ p,p'-bis(N,N'—dimethylaminophenyl)imine | 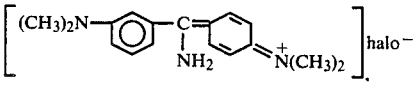 auramine O |
| 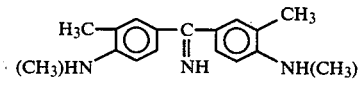 bis[3-methyl-4-(N,N'—dimethylamino)phenyl]imine | 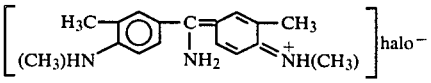 auramine G |
| 3-methyl-4-aminophenyl-p,p'-bis(N,N'—diphenylaminophenyl)methane $[(C_6H_5)HN-C_6H_4]_2CH-(C_6H_3(CH_3)-NH_2)$ | 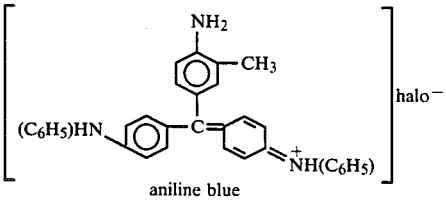 aniline blue |

The second or underlying layer of the imaging film comprises polyacetylenic microcrystals fixedly suspended and uniformly distributed in a binder material in a concentration of between about 10 wt. % and about 90 wt. %, preferably between about 40 wt. % and about 70 wt. % with respect to the binder. The liquid dispersion of normally crystalline polyacetylenic compounds may or may not be aged before drying and imaging according to the process disclosed in my copending patent application, Ser. No. 773,487, filed Sep. 9, 1985. In general, the image receptive polyacetylenic compounds of this invention are any of those described in U.S. Pat.

No. 3,501,302. However, the preferred polyacetylenic compounds are the conjugated diynes, particularly hydrocarbon or acid diynes containing from 20 to 30 carbon atoms. A general formula for these preferred acetylenic compounds is represented by the structure $A—(CH_2)_n-C\equiv C-C\equiv C-(CH_2)_m—B$ wherein m and n are both independently an integer of from 0 to 14 and A and B are independently methyl or carboxyl groups. Specific examples of such polyacetylenes include pentacosa-10,12-diynoic acid; 13,15-octacosadiyne and docosa-10,12-diyne-1,22-dioic acid. Of these, pentacosa10,12-diynoic acid is most preferred since it provides unusually high sensitivity to electron beam exposure. It is to be understood however, that dispersions of other color developing polyacetylenes having a conjugated structure can be employed alone or in admixture with the preferred diynes as the second image receptive layer of the present invention. Such compounds include the diynes of the above structure wherein the A and/or B moieties, in addition to lower alkyl or carboxyl, also can be hydroxy, amido, lower alkyl substituted amido, an aliphatic or aromatic carboxylate ester group having up to 10 carbon atoms, a mono- or di- valent carboxylate metal salt group, halo, carbamyl, lower alkyl substituted carbamyl or tosyl, as well as the corresponding triyne and tetrayne products of the above polyacetylenes having from 20 to 60 carbon atoms and a conjugated structure. Examples of these compounds include 10,12-docosadiynediol, the ditoluene-p-sulfonate of 9,11-eicosadiynoic acid, the monoethyl ester of 10,12-docosadiynedioic acid, the sodium or potassium salt of 10,12-pentacosadiynoic acid, 10,12-docosadiyne chloride, 10,12-pentacosadiyne (m-tolylurethane), 10,12-pentacosadiyne{[(butoxylcarbonyl)-methyl]urethane}, N-(dimethyl)-10,12-pentacosadiynamide, N,N'-bis(α-methylbenzyl) 10,12-pentacosadiyndiamide, triaconta-16,18,20-triynoic acid, etc.

In the preparation of these films, the polyacetylenic crystals may first be dispersed in a non-solvating liquid binder of plastic, resin, colloid or gel and coated on a suitable conductive substrate to a layer thickness of from about 0.1 to about 10 micrometers. The polyacetylene binder is selected for its insolubility in the non-aqueous solvent used to prepare the leuco base polyphenyl methane surface imaging layer so as to maintain the integrity of the polyacetylenic layer during coating with the surface layer. Polyacetylene binders which are soluble in the aliphatic polymeric binder of the polyphenyl methane base cause softening and distortion of the under layer and/or mixing with the top layer to the detriment of image quality. On drying the dispersion, crystals become fixedly positioned in the binder. The drying operation is conducted over a period of from about 20 seconds to about 10 hours at from about ambient temperature up to about 100° C. and is preferably effected at 15° C. to 60° C. for a period from about 1 minute to about 5 hours.

Exemplary binder materials include natural and synthetic plastics, resins, waxes, colloids, gels and the like including gelatins, desirably photographic-grade gelatin, various polysaccharides including dextran, dextrin, hydrophilic cellulose ethers and esters, acetylated starches, natural and synthetic waxes including paraffin, beeswax, polyvinyl-lactams, polymers of acrylic and methacrylic esters and amides, hydrolyzed interpolymers of vinyl acetate and unsaturated addition polymerizable compounds such as maleic anhydride, acrylic and methylacrylic esters and styrene, vinyl acetate polymers and copolymers and their derivatives including completely and partially hydrolyzed products thereof, polyvinyl acetate, polyvinyl alcohol, polyethylene oxide polymers, polyvinylpyrrolidone, polyvinyl acetals including polyvinyl acetaldehyde acetal, polyvinyl butyraldehyde acetal, polyvinyl sodium-o-sulfobenzaldehyde acetal, polyvinyl formaldehyde acetal, and numerous other known photographic binder materials including a substantial number of aforelisted useful plastic and resinous substrate materials which are capable of being placed in the form of a dope, solution, dispersion, gel, or the like for incorporation therein of the photosensitive polyacetylenic composition and then capable of processing to a solid form containing dispersed crystals of the photosensitive crystalline polyacetylenic composition of matter. As is well known in the art in the preparation of smooth uniform continuous coatings of binder materials, there may be employed therewith small amounts of conventional coating aids as viscosity controlling agents, surface active agents, leveling agents, dispersing agents, and the like. The particular binder material employed is selected with due regard to the specific radiant energy and technique to be employed in the particular image-recording application and invariably is a binder material permitting substantial transmission or penetration of that specific radiant energy to be employed.

Because the crystal size of commercially available, normally crystalline polyacetylenes is relatively large and of varying dimension and since for the coatings of the present invention a microcrystalline size, between about 0.01 and about 5 micrometers, preferably between about 0.05 and about 0.2 micrometers, is most desirable, it is generally recommended that the commercial polyacetylene be first dissolved in a solvent from which it can subsequently be recrystallized as fine discrete crystals of a more uniform size, as set forth in said copending patent application Ser. No. 773,487, filed Sep. 9, 1985.

Alternatively, the polyacetylenic compound of the invention can be disposed as a 2-dimensional ordered phase surface layer on the substrate. Polyacetylenes containing at least one hydrophobic group and at least one hydrophilic group are particularly adapted to the preparation of ordered 2-dimensional phases and include the conjugated diynes, triynes and tetraynes of the polyacetylene series having from 10 to 60 carbon atoms. Preferred of these polyacetylenes are the diynes of the above formula having from 20 to 40 carbon atoms wherein either A or B is a hydrophobic group such as linear, branched chain or cyclic alkyl radicals of from 1 to 12 carbon atoms or aryl of from 6 to 9 carbon atoms and the remaining substituent of A or B is a hydrophilic group such as a sulfonic acid, phosphonate, sulfonate, carboxylate, primary amino, primary amido, carboxyl or hydroxy group. Examples of these include 1-phenyl-10,12-docosadiyne-22-ol, (4-methyl)-16,18-triacontadiyne amide, 1-tolyl-11,13-tetracosadiyne sulfonic acid and 1-cyclobutyl-16,18-octatriacontadiyne phosphonate.

Such 2-dimensional ordered phase coatings can be prepared by the Langmiur-Blodgett method, which involves dissolving the polyacetylenic compound in a water immiscible, relatively low boiling solvent and spreading the resulting solution as a film on an aqueous surface, preferably a water surface, at the water air interface. The solvent is then evaporated and a layer of molecules of the polyacetylene compound on the aqueous surface remains. The layer of molecules is then compressed to a surface pressure consistent with the formation of a monomolecular layer of the polyacetylenic compound at the water/air interface and conducive to transfer of the monomolecular film to a solid substrate by passing the substrate through the surface. The dipping procedure is repeated as desired to build-up additional monomolecular layers of polyacetylenic film to a desired thickness of up to about 10 micrometers on the substrate.

For the purposes of the present invention, it is preferred to employ a multi-layered substrate for the polyacetylenic layer of the imaging medium. When such an imaging medium is employed, it essentially contains a separate conductive layer underlying the polyacetylene imaging layer and may also contain separate support and adhesive layers. However, in certain applications, where the polyacetylene binder has sufficient integrity at exposure temperatures, the imaging film may consist solely of crystals suspended in the binder which forms a single layer base film as the imaging medium.

A typical film for the purpose of the present invention comprises microcrystalline polyacetylene in a non-solvating binder or a multilayered 2-dimensional ordered phase of the polyacetylene to form a layer of from about 0.25 to about 500 micrometers, preferably from about 2 to about 10 micrometers, thickness which overlays a substrate of from about 0.5 mil to about 10 mils thickness.

Supports suitable for the purposes of the present invention include any of those commercially available and generally include an electrically conductive layer of between about 0.001 micrometer and about 0.25 micrometer thickness, preferably 0.01 micrometer and about 0.05 micrometer thickness.

Although transparent conductive layers of up to about 0.05 micrometer are most preferred, opaque conductive layers of up to 5 micrometers can also be employed when need arises. The conductive layer limits the capacitance of the charge accepting layer, namely the image-receptive polyacetylenic crystals dispersed in binder or the multilayered 2-dimensional ordered film of the polyacetylenic compound, and typically has a resistiity of $10^6$ ohns/square or less and preferably $10^4$ ohms/square or less. The conductive material is an electrically conductive metal, metal oxide, metal alloy, metal halide or carbon black which metal, metal compound and carbon black components may or may not be suspended in a dispersion medium such as gelatin, dextran, a cellulose ether or ester or any other conventional suspension medium. Suitable metals include gold, silver, platinum, copper, iron, tin, aluminum, indium, nickel, palladium, rhodium and mixtures of these as may occur in alloys and metal oxides or halides. A specific metal oxide which may be suitably employed includes indium-tin oxide. Silver bromide and copper iodide are representative of the metal halides which may be used as the conductive layer. Of these conductive materials, indium-tin oxide is most preferred.

Where desired, the polyacetylenic layer may be more firmly affixed to the conductive layer by means of a thin adhesive layer having a thickness of between about 0.1 micrometer and 1.5 micrometers. When used, suitable adhesives include acrylate based polymers and copolymers, particularly those containing carboxylate moieties such as acrylic acid or methacrylic acid residues and mixtures of these polymers or copolymers with gelatin.

In certain cases, when a conductive metal sheet is employed as the substrate, a separate conductive layer may be eliminated and the image-receptive layer disposed directly on the metal sheet conductive support.

The conductive layer is usually supported by a substrate of between about 0.25 and about 100 mils, preferably 0.5 to 10 mils, thickness. Suitable materials employed as substrates include polyester, polyethylene terephthalate, glass, clay-sized paper, fiberboard, metal sheeting, glazed ceramic, cellulose acetate, polystyrene, polycarbonates or any other conventional support.

The substrate or support can be flexible or rigid, opaque or transparent depending on the final use of the film. Particularly, preferred are the commercial polyester substrates such as MYLAR (polyethylene terephthalate), supplied by E.I. duPont Corporation and HOSTAPAN supplied by American Hoechst.

After the supported polyacetylenic film is formed, a leuco base imaging layer is applied over the polyacetylenic layer. The leuco base layer is prepared by dissolving the leuco dye precursor compound in an inert solvent or mixture of solvents, including acetone, methyl ethyl ketone, methyl isobutyl ketone, dioxane, ethanol, butanol, dichloromethane, cyclohexanone, tetrahydrofuran, carbon tetrachloride, cellosolve, methyl cellosolve, toluene, dichlorobenzene etc., and mixing the resulting solution with a solution of the halogenated polymeric binder in any of the foregoing inert solvents or mixtures of solvents. The selected leuco dye precursor uniformly distributed throughout the binder layer is incorporated at a concentration between about 1 and about 25 wt. %, preferably between about 5 and about 15 wt. % with respect to binder. Coating solutions prepared in this manner are then individually coated in one or more successive layers on the supported polyacetylenic film and dried at a temperature between about 15° C. and about 125° C. under atmospheric pressure for a period of from about 10 seconds to about 5 hours. Taken together, the first and second imaging layers describe a lamina having a thickness of between about 1 and about 13 micrometers disposed on the conductive substrate. In certain cases, e.g. where a thin surface layer is employed, a somewhat thicker second layer, e.g. between about 4 and about 8 micrometers, is recommended. Films containing 3 or more layers can be employed in thicknesses up to about 20 micrometers or more. The resulting film is placed in a specimen holder below the source of radiant energy for the separate layer exposure and color development of a specified image or pattern to be transmitted therein.

Having generally described the invention, reference is now had to the Examples which describe preferred embodiments thereof, but which are not to be construed as limiting to the scope of the invention as more broadly set forth above and in the appended claims.

EXAMPLE 1

Preparation of an Image Receptive Film Having Fixedly Suspended Uniformly Distributed Polyacetylenic Crystals In a glass beaker, 15 g of pentacosa-10,12-diynoic acid was dissolved at 38° C. in 45 g of ethyl acetate to form a solution, Solution A. A second solution, Solution B, was prepared by dissolving 15 g of photographic gelatin in 250 g of water and 30 ml of an aqueous solution containing 3% by weight of surfactant GAFAC-RS-710[1]. Solution B was heated to 40° C. and introduced into a 1 quart size Waring Blender. While blending at high speed, Solution A was added to Solution B over about a 30 second period. Blending was continued for an additional 2.5 minutes before pouring onto a stainless steel tray where it was allowed to chill set. The gelled dispersion was cut into approximately 1 cm cubes and allowed to sit in an airstream to remove ethyl acetate by evaporation. After the ethyl acetate had been removed, the gelled dispersion was reconstituted by melting at 40° C. and adding sufficient water to replace the weight loss that occurred during drying. The crystal size was between about 0.05 micrometer and about 0.22 micrometer The reconstituted dispersion was then frozen at about −15° C. for a period of 2 hours and allowed to warm to room temperature after which it was melted and coated at about 10 micrometers thickness on a 4 mil film base, SIERRACIN INTREX-KS(2); a polyester base carrying an indium-tin oxide conductive coating, having a resistivity of about $10^3$ ohms/square, which had been overcoated with a 1 micrometer thick layer of an adhesion promoting material composed of about 50 wt. % gelatin and 50 wt % of a latex polymer. The coated film was then allowed to dry in air at ambient temperature yielding an image receptive layer 5 μm thick. This film was designated Sample A.

EXAMPLE 2

A solution was made containing 2.5 g of polyvinylchloride, 0.3 g of the leuco base p,p',p''-tris(aminophenyl)carbinol, 50 g of tetrahydrofuran and 10 ml of acetone. This solution was intimately mixed and coated with a wire wound rod over the imaging layer of the film of Sample A, Example 1 and dried at 115° C. for 45 seconds to provide a film having two distinct contiguously disposed imaging layers with the leuco base containing layer as the surface layer. The thickness of this surface layer was 3 micrometers. This film was designated as Sample B.

EXAMPLE 3

Examples 1 and 2 are repeated, except that the leuco base imaging surface layer has a thickness of only 1.0 micrometers. The multilayered film of this example is designated as Sample C.

EXAMPLE 4

The imaging film, Sample B, produced in Example 2 was placed in the specimen holder of an electron beam recording apparatus and a beam of 15 KeV electrons was employed to expose a set of alphabetic characters in the surface leuco base containing layer of the sample. An exposure dosage of about $10^{-5}$ coulomb/cm$^2$ was used. A second exposure was made by using a 20 KeV beam of electrons at a dosage of about $10^{-8}$ coulomb/cm$^2$ to draw a set of numeric characters in the lower, polyacetylene containing, imaging layer. When the film was inspected after the exposure had been made, clear, well resolved images of the two character sets were observed. The alphabetic characters were rendered in a clear deep rose pink color, and the numeric characters were a clear deep blue.

EXAMPLE 5

The exposure procedure of Example 4 was repeated using another film portion of Sample B except that both exposures were made using a 15 KeV electron beam. The result of this experiment was an image of the alphabetic character set in a clear deep rose pink color, but there was no rendition of the numeric character set. Even when the exposure of the numeric character set is made at a dosage of $10^{-7}$ coulomb/cm$^2$, no image can been seen. This experiment demonstrates that at low doses, i.e. less than about $10^{-7}$ c/cm$^2$ of 15 KeV electrons, the leuco dye containing layer is insensitive to exposure. Furthermore it also demonstrates that a 15 KeV beam of electrons will not produce an image in the lower, polyacetylene containing, layer since the electrons cannot penetrate beyond the 3 micrometer thickness of the surface layer. The expected range of 15 KeV electrons in this layer is about 2.8 micrometers.

EXAMPLE 6

The exposure procedure of Example 4 is used to create images of the alphabetic and numeric character sets upon Sample C film of Example 3. The result of this experiment is a clear blue image of the numeric characters and very dark blue image of the alphabetic characters. The interpretation is that the 15 KeV beam used to produce the alphabetic set has penetrated well beyond the 1 micrometer thickness of the surface, leuco base containing layer and has exposed the lower, polyacetylene containing, layer as well. Since the dosage is relatively high, the resulting image is dominated by the blue color of the lower imaging layer. This experiment demonstrates the criticality of choosing a combination of surface layer thickness and beam energy such that an image can be created exclusively in the surface layer, to the exclusion of the lower layer where the electrons cannot penetrate.

EXAMPLE 7

A solution was made containing 2.5 g of polyvinylchloride, 50 g of tetrahydrofuran and 0.3 g of the leuco carbinol base of malachite green. This solution was intimately mixed and coated with a wire wound rod over the imaging layer of the film of Sample A and dried at 75° C. for 2 minutes to provide a film having two distinct contiguously disposed imaging layers with the leuco base containing layer as the surface layer. The thickness of this surface layer was 3 micrometers. This film was designated as Sample D.

EXAMPLE 8

The procedure of Example 4 was employed to expose a strip of the film of Sample D. Alphabetic characters were exposed with a 15 KeV beam at about $10^{-5}$ coulomb/cm$^2$. Numeric characters were exposed at a dosage of about $10^{-8}$ coulomb/cm$^2$ with a 30 KeV beam. Clean, clear, well resolved images of the character sets resulted. The alphabetic characters were a deep green and the numeric characters were deep blue. This exposed film was designated as Sample E.

EXAMPLE 9

The exposed film of Sample E was briefly heated to about 70° C. whereupon the blue image of numeric characters was changed permanently to a clear, well resolved orange yellow image. The green image of the alphabetic characters remained unchanged. This exposed film was designated as Sample F.

EXAMPLE 10

The exposed and heated film of Sample F was returned to the holder of the electron beam exposure device and a 20 KeV of electrons was employed to expose a series of small geometric figures at a dosage of about $10^{-8}$ coulomb/cm$^2$. When this exposed film was inspected, clear, well resolved, clean images in three distinct colors were observed. A set of alphabetic characters in green, a set of numeric characters in orange-yellow and a set of geometric figures in a deep blue.

EXAMPLE 11

The film of Sample B was placed in the electron beam exposure device and a 15 KeV beam of electrons was used to create an image of a set of geometric figures at a dosage of about $10^{-5}$ coulomb/cm$^2$. This image was seen to be a clear, deep rose pink color when the sample was removed from the exposure device.

A second image was now generated by exposing the film with a source of ultraviolet light, predominantly below 300 micrometers in wavelength, through a stencil mark bearing alphabetic characters. Since the lower, polyacetylene containing, layer is vastly more sensitive to ultraviolet light than the leuco dye containing layer, the alphabetic character set was rendered in a clear deep blue in sharp contrast to the rose pink, geometric figures exposed by the electron beam in the surface, leuco dye, layer.

It will be understood that many modifications and alterations in the foregoing examples will become aparent from the disclosure. For example, any of the other charged particle beam sources can be substituted in the examples for the electron beam when employed at dosage levels equivalent in effect to the electron beam dosage levels recited above.

It is also within the scope of this invention to employ a recording film comprising a conductive material supporting three or more individual and superimposed imaging layers, each composed of a binder containing a dissimilar photosensitive compound capable of developing distinguishable hue or color and to image said imaging layers employing separate and distinct beam energies, each modulated to penetrate the individual imaging layers. Particularly desired of these is such a recording film having three separate superimposed imaging layers, two of which contain different polyphenylmethane dye precursor compounds, or two containing different polyacetylenic compounds, which are developed individually to display distinctive portions of the transmitted information in a plurality of distinguishable colors. In this case, progressively increasing beam energies within the range of from about 1 to about 50 KeV are used for the imaging layers. In a broad sense, a plurality of such superimposed layers, each containing a distinctive photosensitive compound, may be regarded as forming a composite surface layer of the present recording film.

These and many more modifications which become evident from the foregoing disclosure are also included within the scope of this invention.

What is claimed is:

1. An image receptive film capable of multicolor development by energy transmitted by a source of radiant energy, which comprises:

(a) a first imaging layer composed of an aliphatic polymeric binder having from about 40 to about 70 wt. % labile halogen and capable of dehydrohalogenation at address points upon exposure to a source of radiant energy, said binder containing a uniformly dispersed leuco base polyphenylmethane compound capable of forming a halide salt dye upon generation of hydrogen halide from said binder;

(b) a separate imaging layer disposed below said first layer and composed of a uniformly dispersed photosensitive polyacetylenic compound having at least two acetylenic linkages in a conjugated system and capable of forming a dye of a color distinguishable from the halide salt dye upon exposure to a source of radiant energy and (c) a conductive support for imaging layers (a) and (b).

2. The film of claim 1 wherein the polyacetylenic compound is a microcrystalline diacetylene or a triacetylene and is uniformly dispersed in an inert organic polymeric binder which is insoluble in the aliphatic polymeric binder employed in the first imaging layer.

3. The film of claim 2 wherein the image receptive film comprises three or more imaging layers.

4. The film of claim 3 wherein the image receptive film comprises said first imaging layer (a) and two photosensitive polyacetylenic layers successively disposed below layer (a).

5. The film of claim 2 wherein the leuco base polyphenylmethane is a diphenylmethane or a triphenylmethane compound which is dispersed in an inert binder selected from the group of vinyl chloride homopolymer, vinylidene chloride homopolymer and vinyl chloride/vinylidene chloride copolymer.

6. The film of claim 2 consisting of a first imaging layer having a thickness of between about 0.1 and about 8 micrometers and a second imaging layer contiguously disposed below said first imaging layer and having a thickness of between about 0.1 and about 10 micrometers.

7. The film of claim 5 wherein the leuco base is malachite green carbinol.

8. The film of claim 5 wherein the leuco base is pararosaniline carbinol.

9. The film of claim 2 wherein the polyacetylenic compound is pentacosa-10,12-diynoic acid and the inert organic polymer binder is gelatin.

10. The process of imaging the film of claim 1 which comprises subjecting layer (a) to a pattern imaging by electron beam exposure at an energy sufficient to penetrate layer (a) and at an exposure dosage sufficient to color image layer (a) in the pattern transmitted from the electron beam source and separately subjecting layer (b) to a dissimilar pattern imaging by UV light exposure at an energy sufficient to penetrate layer (b) and at a exposure dosage sufficient to image layer (b) in the pattern transmitted from the radiant energy source in a color distinguishable from the color in layer (a).

11. The process of imaging the film of claim 1 which comprises subjecting layer (a) to a pattern imaging by radiant energy exposure at an energy sufficient to penetrate layer (a) and at an exposure dosage sufficient to color image layer (a) in the pattern transmitted from the radiant energy source and separately subjecting layer (b) to a dissimilar pattern imaging by radiant energy exposure at an higher energy sufficient to penetrate layer (b) and at a lower exposure dosage sufficient to image layer (b) in the pattern transmitted from the radiant energy source in a color distinguishable from the color in layer (a).

12. The process of claim 11 wherein layer (b) is imaged before layer (a).

13. The process of claim 11 wherein layer (a) is imaged before layer (b).

14. The process of claim 11 wherein layer (a) has a thickness between about 0.1 and about 8 micrometers and is subjected to an electron beam energy of between about 1 KeV and about 30 KeV at an exposure dosage of between about $1\times10^{-7}$ and about $1\times10^{-1}$ C/cm$^2$ and layer (b) has a thickness between about 0.1 and about 10 micrometers and is subjected to a higher electron beam energy between about 5 KeV and about 40 Kev and a lower exposure dosage between about $1\times10^{-10}$ and about $1\times10^{-5}$ C/cm$^2$.

15. The process of claim 14 wherein layer (a) has a thickness of from about 0.5 to about 4 micrometers and is subjected to an electron beam energy between about 5 and about 20 KeV and an exposure dosage between about $1\times10^{-6}$ and about $1\times10^{-4}$ C/cm$^2$ and layer (b) has a thickness of from about 0.5 to about 5 micrometers and is subjected to a higher electron beam energy between about 10 and about 30 KeV and a lower exposure dosage between about $1\times10^{-9}$ and about $1\times10^{-6}$ C/cm$^2$.

16. The process of claim 14 wherein layer (a) contains a triphenylmethane or a diphenylmethane as the leuco base polyphenylmethane dye precursor.

17. The process of claim 16 wherein the binder for the polyphenylmethane is selected from the group consisting of vinyl halide homopolymer, vinylidene halide homopolymer and vinyl halide/vinylidene halide copolymer.

18. The process of claim 14 wherein layer (a) contains malachite green carbinol as a leuco base polyphenylmethane dye precursor and the corresponding halide salt dye is malachite green.

19. The process of claim 14 wherein layer (a) contains pararosaniline carbinol as a leuco base polyphenylmethane dye precursor and the corresponding halide salt dye is pararosaniline.

20. The process of claim 14 wherein layer (b) contains a diacetylene or a triacetylene as the polyacetylenic compound.

21. The process of claim 14 wherein layer (b) contains pentacosa-10,12-diynoic acid as the polyacetylene.

22. The process of claim 14 wherein layer (a) contains p,p',p''-tris(aminophenyl)carbinol as the leuco base precursor.

23. The process of claim 14 wherein layer (a) contains the leuco base of malachite green.

24. The process of claim 11 wherein the imaging film comprises at least three imaging layers each having a thickness of between about 0.1 and about 8 micrometers and wherein each layer of said film is imaged with a different pattern by electron beam exposure at separate energy levels sufficient to penetrate the desired layer; said energy levels being within the range of from about 1 to about 50 KeV.

25. The process of claim 11 wherein layer (b) is composed of a thermochromic photosensitive polyacetylenic compound and the imaging film is subsequently subjected to heating at a temperature sufficient to alter the original color of the image in layer (b).

26. The process of claim 25 wherein the thermochromic photosensitive polyacetylene layer (b) of the imaging film is subjected to a temperature of between about 60° C. and about 140° C. to alter the original color of the image in layer (b).

27. The process of claim 25 wherein the imaging film, having an altered color image in layer (b), is subjected to re-exposure with a pattern distinctive from the patterns developed in layers (a) and (b), at a temperature insufficient to alter the original color which is initially developed in layer (b).

28. The process of claim 27 wherein the film is re-exposed at a temperature not exceeding 50° C.

* * * * *